United States Patent [19]

Signoretto

[11] Patent Number: 4,973,035

[45] Date of Patent: Nov. 27, 1990

[54] STACKING AND COMPACTING DEVICE FOR PHOTOGRAPHIC PRINTS

[75] Inventor: Roberto Signoretto, Venice, Italy

[73] Assignee: Systel International S.p.A., Milan, Italy

[21] Appl. No.: 266,063

[22] Filed: Nov. 2, 1988

[30] Foreign Application Priority Data

Nov. 6, 1987 [IT] Italy ..... 84171 A/87

[51] Int. Cl.[5] ..... B65H 41/00

[52] U.S. Cl. ..... 270/52; 270/58; 271/192; 414/790.3; 414/790.5; 414/794.2; 414/907

[58] Field of Search ..... 270/52, 58; 271/192, 271/189; 414/791, 790.3, 790.5, 790.6, 793.9, 794.2, 794.4, 907

[56] References Cited

U.S. PATENT DOCUMENTS

| | | | |
|---|---|---|---|
| 3,205,794 | 9/1965 | Califano | 414/790.6 |
| 3,833,212 | 9/1974 | Wise | 270/58 |
| 4,547,112 | 6/1985 | Steinhart | 414/791 |

FOREIGN PATENT DOCUMENTS

| | | | |
|---|---|---|---|
| 1199696 | 8/1965 | Fed. Rep. of Germany | 414/790.6 |
| 57-199753 | 12/1982 | Japan | 270/52 |
| 61-243764 | 10/1986 | Japan | 414/907 |
| 61-291363 | 12/1986 | Japan | 271/189 |
| 99760 | 4/1962 | Norway | 414/794.2 |
| 582613 | 12/1976 | Switzerland | 414/790.5 |

*Primary Examiner*—Edward K. Look
*Assistant Examiner*—Therese M. Newholm
*Attorney, Agent, or Firm*—Hoffman, Wasson, Fallow & Gitler

[57] ABSTRACT

A device for stacking and compacting photographic prints, and inserting stacks of prints into envelopes, includes a selector for directing individual prints along separate paths, according to their characterisitcs, toward a multiple stacking chamber at the end of the print paths, where the prints are formed into separate stacks. A compactor for compacting then compresses the stacks against a portion of the stacking chamber, and a pusher ejects the packs from the compactor in a direction orthogonal to the direction in which they entered.

10 Claims, 1 Drawing Sheet

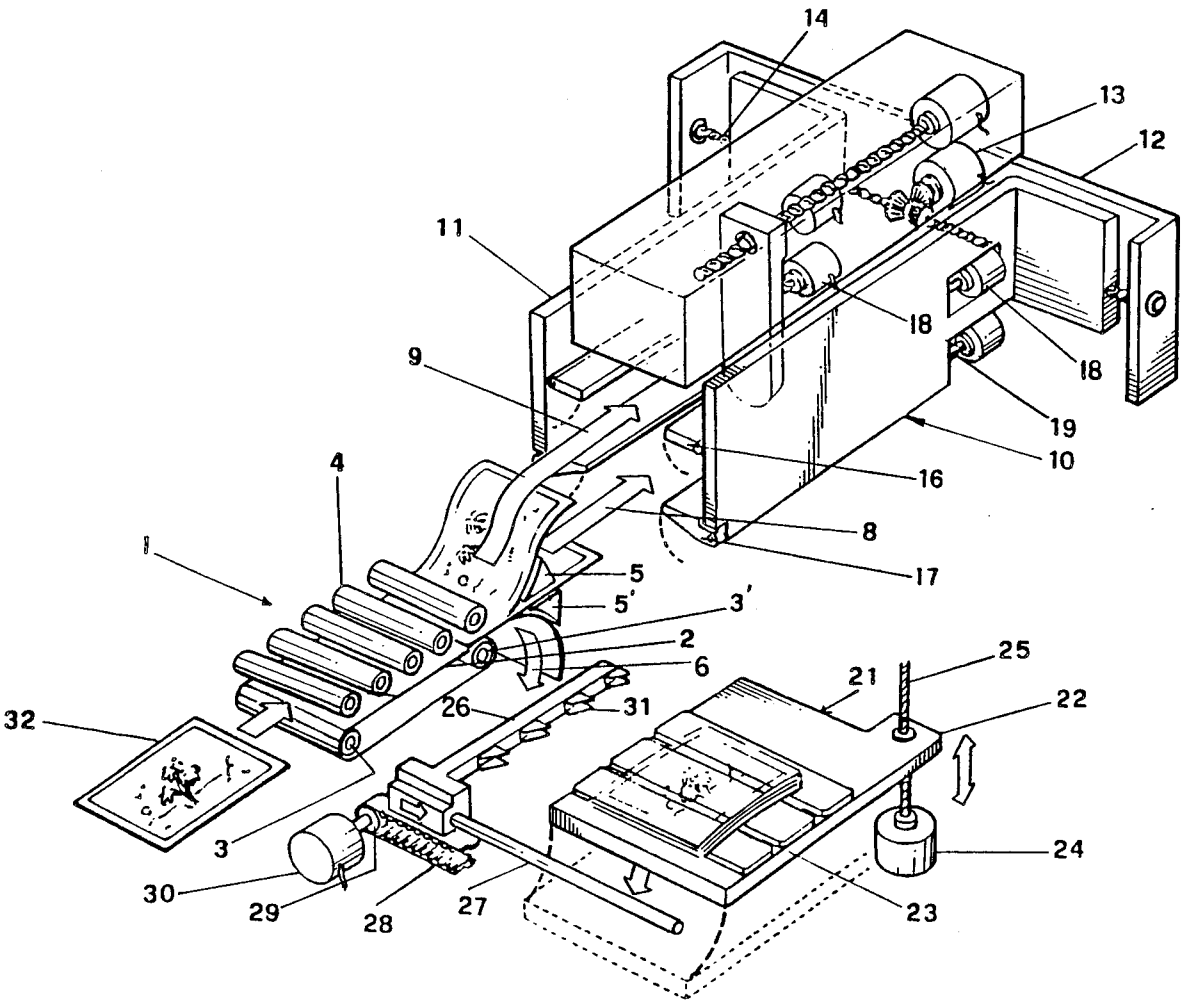
12
13
18
19
10
14
18
16
17
8
11
9
4
1
5
5'
3'
2
6
31
26
3
32
25
22
24
21
23
27
28
29
30

STACKING AND COMPACTING DEVICE FOR PHOTOGRAPHIC PRINTS

This invention relates to a stacking and compacting device for sheets, particularly photographic prints.

In photographic laboratories the negatives are printed in succession on a continuos strip of photosensitive paper. This is then cut into individual prints which are then stacked to form a pack for insertion into a wallet, in which they are returned to the customer. This succession of operations has been effected for some time with automatic equipment enabling the photographic laboratory to process the orders at a high speed of up to 36,000 prints per hour.

However the ever increasing requirements of photographic laboratories mean that this known equipment must provide ever better performance in terms of both its rate of operation and the arrangement of the prints in the pack independently of the order in which they are present in the continuous strip leaving the printing station.

Thus for example as each order could contain some prints which have to be reprinted, there is already a requirement for grouping the good prints in the bottom of the wallet stack, and the prints to be reprinted in the top to facilitate the manual work of the operator responsible for reprinting.

Again, if two prints are required for each negative, these prints then being adjacent in the continuous strip, two packs must be formed each with a complete set of prints, for insertion into two different wallets, as it is generally not possible to insert them all into a single wallet because of its limited capacity.

An object of the invention is to provide a device which can take the prints arranged in the order in which they are separated from a continuos strip and form them into more than one pack in which they are grouped and stacked according to the required criteria.

Moreover, the prints are generally deformed with the result that the overall size of the pack formed from them is increased unacceptably in view of the limited capacity of the wallets which are to receive them, to result in increased difficulty in inserting them, and therefore a further object of the invention is to provide compacting of the stacked prints before they are inserted into the wallet.

A further object of the invention is to effect this compacting outside the zone reserved for print stacking, so as to be able to handle two different orders simultaneously and thus reduce the average handling time per order.

A further object of the invention is to be able to convey the pack or packs of prints orthogonally to their major side, i.e. orthogonally to the direction along which the individual prints arrive from the cutting station, in order to be able to use wallets with pockets having their opening along their major side.

These and further objects which will be apparent from the description given hereinafter are attained according to the invention by a stacking and compacting device for sheets, particularly photographic prints, characterised by comprising:

a selector for the various sheets, by which said sheets for forming different packs are conveyed along a number of vertically superposed paths, a multiple stacking chamber formed from two lateral walls disposed along the prolongation of the different paths, and provided in correspondence with each of these latter with pairs of downwardly rotatable ledges, the lower pair of said ledges being disposed in correspondence with the lower edge of said walls, a compacting member acting in the sense of pressing the pack of sheets from below against the lower pair of said ledges, a pusher interposed between said lower pair of ledges and said compacting member and acting in the sense of transferring the compacted pack of sheets orthogonally to the direction in which they enter the stacking chamber.

The present invention is described in detail hereinafter with reference to the accompanying drawing showing an exploded perspective and partially transparent view of a stacking and compacting device for photographic prints according to the invention.

As can be seen from the drawing the device according to the invention comprises a conveyor member 1 disposed at the outlet of a conventional cutter (not shown on the drawing) and formed from an endless belt 2 extending between two rollers 3, 3', one of which is motorized. On the upper surface of the endless belt 2 there are provided a plurality of presser rollers 4 which are mounted idly on respective shafts and are kept with their lateral surface elastically in contact with said belt 2.

At the outlet end of said belt conveyor 2, i.e. at the end distant from the cutter, there is provided a selector device of known type, consisting essentially of hinged blades 5, 5' which according to their angular position provide said belt 2 with a different exit in order to convey the individual prints 32 towards a different path. In the illustrated example the two blades enable three different exits to be obtained, with three corresponding different paths for the prints. The lower path 6 is the rejects path and deviates the prints 32 towards a collection bin, the middle (horizontal) path 8 is the path for good prints, and the upper path 9 is the path for prints to be reprinted. After a short divergent portion the two paths 8 and 9 become parallel and lead to a multiple stacking chamber indicated overall by 10. It comprises a pair of lateral walls 11 mounted on transverse guides 12 and coupled to an electric motor 13 by a system of threaded pins 14 to enable said walls 11 to slide transversely in opposing directions to adapt the chamber 10 to the transverse dimensions of the prints to be handled, as described hereinafter.

Two pairs of ledges 16, 17 are hinged to the walls 11 to rotate between two extreme positions, one horizontal and the other rotated vertically downwards, under the control of magnets 18 fixed to their hinging shafts 19. The lower pair 17 is disposed at the same level as the middle path 8 for the prints 32 and is hinged to the lower edge of the walls 11, whereas the upper pair 16 is disposed at the same level as the upper path 9 for the prints.

The lower surface of the upper ledges 16 is perfectly smooth, while the lower surface of the lower ledges 17 comprises a plurality of equidistant transverse grooves the purpose of which will be apparent hereinafter.

A compacting member is provided below the chamber 10. It consists essentially of a plate 22 provided on its upper surface with a plurality of transverse grooves 23 facing the transverse grooves of the lower ledges 17. The plate 22 is mobile between a lower rest position and an upper working position, at which its distance from the ledges 17 is equal to the maximun thickness which the pack of prints 32 can assume when compacted, to be able to be inserted into the wallet.

Said plate 22 is driven vertically by an electric motor and a screw coupling 25.

A transverse pusher member is provided external to the stacking chamber 10 at a level just below the lower shelves 17, and consists essentially of a bar disposed parallel to the walls 11 and having one end slidable along a transverse guide 27. The same end of the bar 26 is connected to a belt 28 extending between two deviation rollers 29 and driven in both directions by an electric motor 30 connected to the shaft of one of them. Grippers 31 with arms having a thickness equal to the depth of the grooves 23 and a distance apart equal to the minimun distance between the plate 22 and ledges 17 are fitted to the bar 26 at a pitch equal to the pitch of said grooves.

The device according to the invention also comprises a plurality of sensors, automatic controls and servomechanisms which overall ensure implementation of the correct operating cycle and are mentioned in the operating description given hereinafter as the need arises. The operation will be described on the assumption that those prints 32 arriving from the cutter which are not discarded are to be stacked into two overlying packs, a lower one formed from good prints and an upper one formed from prints to be reprinted.

As the prints from the cutter reach the blades 5, 5', these are operated under the control of a computer (not shown) which has previously memorized in accordance with conventional criteria the information relative to the manner in which the individual prints are to be handled, so as to deviate them along the corresponding path. For example in the case of a print to be discarded, the lower blade 5' is raised to deviate an arriving print along the path 6. In the case of a good print the blades are not operated whereas in the case of a print to be reprinted the upper plate 5 is lowered to deviate the print along the path 9.

In this manner the good prints which pass along the middle path 8 are deposited on each other on the lower ledges 17, which at this stage are horizontal, whereas the prints to be reprinted, which pass along the path 9, are deposited on each other on the upper ledges 16 which are also horizontal.

Before the prints of that particular order are handled, the computer which controls the print selector adjusts the distance between the two walls 11 by means of the motor 13 to correspond to the width of those particular prints.

When the prints 32 of that order have all passed through, a subsequent automatic command is fed by the computer to cause the two magnets 18 of the upper ledges 16 to rotate through 90° so that these turn downwards to allow those prints which have to be reprinted to fall onto the underlying good prints. A further command to the two magnets 18 of the lower ledges 17 causes the thus formed pack of prints to fall onto the underlying plate 22 after which a further command to the magnets 18 of the two pairs of ledges 16 and 17 returns them to their horizontal position, to enable the cycle to be repeated for a new order.

In the meantime, a command to the motor 24 causes the plate 22 to rise to compact the pack of prints 32 between said plate 22 and the lower surface of the pair of lower ledges 17. When compacting is complete, a command is fed to the electric motor 30 which then causes the bar 26 to traverse.

As a result of this traversing movement, the grippers 31, which slide with their arms in the lower grooves 23 and in the grooves on the underside of the ledges 17, grip the compacted pack of prints and transfer it outside the compacting zone, for example to a wallet-filling station.

The bar and plate 22 then undergo return travel so that the machine is ready for repeating the operating cycle, which could in fact already have been started by sorting the prints 32 of the new order.

The aforegoing description relates, as stated, to the format of a single pack in which the good prints are disposed at the bottom and any prints to be reprinted are disposed at the top.

The device according to the invention is also suitable for other uses, such as for forming two identical packs of prints for insertion into two different wallets.

In this case, each negative is printed twice successively during printing, and consequently the continuous strip of prints comprises a succession of pairs of identical photographs, which remain identical after passage through the cutter. The prints leaving the cutter encounter the selector which, except for the discards, is operated alternately with the upper blade " to feed one print along the middle path 8 and the next identical print along the upper path 9, to form two identical packs in the stacking chamber 10, one supported by the lower ledges 17 and the other supported by the upper ledges 16.

After the two packs have been formed, an automatic command is fed by the computer to turn the two lower ledges 17 downwards and cause the pack of prints supported by it to fall onto the underlying plate 22, which then compacts them in the manner previously described to then transfer them into the wallet-filling station. In the meantime a command has opened the upper ledges 16 to cause the pack of prints supported thereby to fall onto the lower ledges 17 already returned to their horizontal configuration. After the plate 22 has returned to its lower position, a subsequent command again opens the lower ledges 17 to cause the second pack to also fall onto the plate 22, to be compacted and then transferred to the wallet-filling station.

The description given in relation to a stacking chamber 10 with two pairs of ledges is also valid for stacking chamber with N pairs of ledges for the formation of up to N packs of prints to be inserted into wallets simultaneously or successively, according to the particular requirements. The only expedient to follow is that, especially in the case of successive wallet insertion of the individual piles of prints, the order in which they are to be disposed at the various levels in the stacking chamber 10 must obviously correspond, from the bottom upwards, to the order in which they are to be inserted into wallets.

From the aforegoing it is apparent that the stacking and compacting device for photographic prints according to the invention has numerous advantages, and in particular:

it enables packs of prints to be formed in accordance with the required print grouping criteria within each pack, it enables the pack of prints to be compacted outside the stacking zone, to enable these two operations to be performed simultaneously on two different orders and thus reduce the overall average handling time for each order, it enables standard wallets to be used directly in the successive wallet filling station, these being wallets which because they contain side-opening pockets require the pack of prints to be transferred parallel to their shorter side, i.e. orthogonal to the direction in which they arrive from the cutting station, it enables the prints to be compacted before they are transferred into the wallet-filling station, so preventing in particular any resistance to the feed of the pack and any deformation thereof, especially if formed of only a few prints, and thus avoiding the difficulty which occurs in all those cases in which an uncompacted pack of prints is fed between wedge guides for its compaction.

What is claimed:

1. A stacking and compacting device for photographic prints, comprising:

a selector for the prints by which said prints for forming different packs are conveyed along vertically superposed paths, a stacking chamber formed from two lateral walls disposed along the prolongation of different superposed paths, said lateral walls being transversely displaceable and provided, in correspondence with each of these paths, with pairs of downwardly rotatable ledges, a lower pair of said ledges being disposed in correspondence with a lower edge of said walls, a compacting member, placed under the stacking chamber, for compressing a pack of prints, having exited said chamber, from below against the lower pair of said ledges, and a pusher interposed between said lower pair of ledges and said compacting member and acting to transfer the compressed pack of prints orthogonally to the direction in which they enter the stacking chamber.

2. A stacking and compacting device for sheets, particularly photographic prints, comprising:

a selector for for directing sheets for forming different packs along plural vertically superposed conveying paths, a multiple stacking chamber for forming plural packs of sheets, comprising two lateral walls disposed along an extension of the conveying paths, and provided, in correspondence with each of the paths, with plural pairs of downwardly rotatable ledges, a lower pair of said ledges being disposed in correspondence with a lower edge of said walls, a compacting member for compressing a pack of sheets from below against the lower pair of said ledges, and a pusher interposed between said lower pair of ledges and said compacting member, and acting to transfer a compressed pack of sheets orthogonally to the direction in which the sheets enter the stacking chamber, wherein the two lateral walls of the stacking chamber can slide along transverse guides, under the control of an electric motor, to adapt said chamber to the width of the sheets.

3. A device as claimed in claim 2, characterised in that each ledge (16, 17) is hinged to the respective wall (11) by a shaft (19), to the end of which there is connected a drive member (18) for rotating said shaft through an angle of about 90° in both directions.

4. A device as claimed in claim 3, characterised in that the drive member (18) is a rotary magnet.

5. A device as claimed in claim 2, characterised in that the compacting member (21) consists of a horizontal plate (22) mobile vertically between a lower rest position and an upper compacting position, close to the two lower ledges (17).

6. A device as claimed in claim 5, characterised in that the compacting member (21) comprises an electric motor (24) coupled to said plate (22) by a worm system (25) of vertical axis.

7. A device as claimed in claim 2, characterised in that the pusher (26) consists of a bar mobile orthogonally to the two walls (11) of the stacking chamber (10).

8. A device as claimed in claim 7, characterised in that the pusher (26) is fixed to a belt (28) extending between two deviation rollers (29) one of which is driven in both directions, to cause said pusher (26) to move transversely along at least one guide (27).

9. A device as claimed in claim 7, characterised in that the pusher (26) is provided with a plurality of C-shaped grippers (31), of size corresponding to the maximum thickness of the formed pack of sheets (32).

10. A device as claimed in claim 5, characterised in that the lower surface of the lower ledges (17) and the upper surface of the plate (22) are provided with a plurality of transverse facing grooves (23) along which slide horizontal gripper arms (31), which are not thicker than the depth of said grooves.

* * * * *